US006234861B1

(12) United States Patent
Ichii et al.

(10) Patent No.: US 6,234,861 B1
(45) Date of Patent: May 22, 2001

(54) HIGH PERFORMANCE YO-YO

(75) Inventors: Junji Ichii, Mitoyo-gun; Nobuhiro Arai, Musashino, both of (JP)

(73) Assignee: Matsushita Electric Industrial Co., Ltd., Tokyo (JP)

( * ) Notice: Subject to any disclaimer, the term of this patent is extended or adjusted under 35 U.S.C. 154(b) by 0 days.

(21) Appl. No.: 09/358,819

(22) Filed: Jul. 22, 1999

(30) Foreign Application Priority Data

Jul. 24, 1998 (JP) ..... 10-209698

(51) Int. Cl.[7] ..... A63H 1/30; A63H 1/06
(52) U.S. Cl. ..... 446/250; 446/247
(58) Field of Search ..... 446/250, 251, 446/252, 249, 248, 247, 255

(56) References Cited

U.S. PATENT DOCUMENTS

| | | | | |
|---|---|---|---|---|
| 2,579,022 | * | 12/1951 | Spencer et al. | 446/250 |
| 3,653,148 | * | 4/1972 | Finkel | 446/255 |
| 3,945,146 | * | 3/1976 | Brown | 446/249 |
| 4,130,962 | * | 12/1978 | Ennis | 446/250 |
| 4,207,701 | * | 6/1980 | Kuhn | 446/250 |
| 4,332,102 | * | 6/1982 | Caffrey | 446/250 |
| 4,555,235 | * | 11/1985 | Burroughs | 446/250 |
| 4,867,727 | * | 9/1989 | Lanius | 446/250 |
| 4,895,547 | | 1/1990 | Amaral . | |
| 5,961,366 | * | 10/1999 | Wei | 446/250 |
| 5,984,759 | * | 11/1999 | O'Sullivan | 446/250 |
| 6,004,183 | * | 12/1999 | Dixon et al. | 446/250 |
| 6,080,035 | * | 6/2000 | Pekarsky et al. | 446/250 |

FOREIGN PATENT DOCUMENTS

| | | | | |
|---|---|---|---|---|
| 197 31 087 | * | 2/1998 | (DE) | A63H/1/30 |
| 57-12633 | | 3/1982 | (JP) . | |
| 6-15645 | | 4/1994 | (JP) . | |

* cited by examiner

*Primary Examiner*—Jacob K. Ackun
*Assistant Examiner*—Urszula M. Cegielnik
(74) *Attorney, Agent, or Firm*—Wenderoth, Lind & Ponack, L.L.P.

(57) ABSTRACT

A yo-yo includes a pair of rotary elements spaced from each other and each having a cavity, a bearing portion formed on each of the pair of rotary elements at a center thereof, and an axle detachably received in the bearing portion so as to be rotatable together with the pair of rotary elements. The axle has an engaging portion formed at each of opposite ends thereof. The axle is loosely inserted into a generally cylindrical spool interposed between the pair of rotary elements. A locking device having a pair of locking parts is mounted in the cavity, and the pair of locking parts have respective holding portions for detachably holding the engaging portion therebetween.

20 Claims, 7 Drawing Sheets

HIGH PERFORMANCE YO-YO

BACKGROUND OF THE INVENTION

1. Field of the Invention

The present invention relates to the structure of a yo-yo.

2. Description of the Related Art

Yo-yos that are very familiar to everyone as toys are disclosed in, for example, U.S. Pat. No. 4,895,547 or Japanese Patent Publication (examined) No. 57-12633.

The yo-yo disclosed in U.S. Pat. No. 4,895,547 includes two yo-yo halves or rotary elements spaced a predetermined distance from each other, an axle for connecting the two yo-yo halves, and a spool mounted for free rotation on the axle. Threaded ends of the axle are screwed into threaded inserts embedded in the two yo-yo halves, respectively.

In this yo-yo, however, there is a possibility that the threaded ends of the axle may be loosened or removed from the inserts when a rapid reverse spin of the yo-yo halves occurs during operation.

The yo-yo disclosed in Japanese Patent Publication No. 57-12633 includes two yo-yo halves spaced from each other and each having a center hole defined therein. This yo-yo has a sleeve structure in which opposite ends of an axle are securely received in sleeves fitted inside the center holes of the two yo-yo halves, respectively.

Although the sleeve structure achieves complete fixing of the two yo-yo halves, maintenance work such as, for example, replacement of parts are not possible.

SUMMARY OF THE INVENTION

The present invention has been developed to overcome the above-described disadvantages.

It is accordingly an objective of the present invention to provide an improved yo-yo that eliminates the danger of rotary elements being removed from an axle during operation and facilitates maintenance work by allowing dismantling of the yo-yo as occasion demands.

In accomplishing the above and other objectives, a yo-yo according to the present invention includes a pair of rotary elements spaced from each other and each having a cavity defined therein, a bearing portion formed on each of the pair of rotary elements at a center thereof, and an axle detachably received in the bearing portion so as to be rotatable together with the pair of rotary elements. The axle has an engaging portion formed at each of opposite ends thereof. A generally cylindrical spool is interposed between the pair of rotary elements, with the axle being loosely inserted into the generally cylindrical spool. At least one locking means is mounted in the cavity and has a holding portion for pressing the engaging portion inwardly at all times during rotation of the rotary elements about the rotation axis, thereby holding the pair of rotary elements on the opposite ends of the axle.

With this arrangement, the coupling between the rotary elements and the axle is positively maintained by the locking means even during operation. Also, the yo-yo can be easily disassembled by releasing the pressing of the engaging portion by the holding portion, facilitating maintenance work such as, for example, replacement of parts.

Advantageously, the locking means has an elastic member for biasing the holding portion against the engaging portion. The elastic member acts to enhance the reliability in the coupling between the rotary elements and the axle.

Preferably, the locking means includes a support member, a first and a second lever extending from the support member so as to be positioned on respective sides of the axle. The holding portion is formed with the first lever and pressed against the engaging portion by making use of a centrifugal force created on the second lever during rotation of the pair of rotary elements. Accordingly, removal of the rotary elements from the axle does not occur during operation.

In this case, the elastic member extends from a free end of the first lever. Although the structure is very simple, the rotary elements are positively held on the opposite ends of the axle.

Conveniently, the holding portion is arcuated and a circumferential groove formed at each of the opposite ends of the axle is employed as the engaging portion. By so doing, the coupling between the rotary elements and the axle is ensured, preventing removal of the rotary elements from the axle during operation.

Alternatively, the engaging portion is a radially extending hole formed in the axle, and the holding portion is a radially inwardly extending projection formed on the locking means. This structure also ensures the coupling between the rotary elements and the axle.

Advantageously, the locking means has a locking portion, and each of the pair of rotary elements has a locking member. In this case, the locking member is brought into contact with the locking portion to prevent engagement of the holding portion with the engaging portion from being released, thereby preventing removal of the rotary elements from the axle.

Each of the pair of rotary elements may include a base and a cap disposed outwardly of the base. In this case, the locking means having the locking portion is mounted on one of the base and the cap, while the locking member is mounted on the other of the base and the cap. The locking member is brought into contact with the locking portion by rotating one of the base and the cap relative to the other.

With this arrangement, the coupling between the rotary elements and the axle is positively maintained even during operation. Also, the yo-yo can be easily disassembled when maintenance is needed.

It is preferred that the cap has an engagement releasing member mounted thereon for releasing engagement of the engaging portion with the holding portion. Disassembly of the yo-yo can be easily carried out with a simple operation sing the engagement releasing member.

The engagement releasing member includes an inclined portion having an inclined surface. When the engagement releasing member is pressed inwardly, the inclined surface of the inclined portion is brought into contact with the holding portion and then causes the holding portion to slide radially outwardly, thereby releasing the engagement of the engaging portion with the holding portion.

The engagement releasing member may have a guide portion formed thereon and is rotatably mounted on the cap. When the engagement releasing member is rotated, the guide portion causes the holding portion to slide radially outwardly, thereby releasing the engagement of the engaging portion with the holding portion.

The engagement releasing member of the above-described structure facilitates assembly or disassembly of the yo-yo at the time of maintenance.

Conveniently, a portion of the cap has a first side wall, a second side wall lower than the first side wall, and an inclined portion connecting the first and second side walls, while a portion of the base is of a configuration substantially complementary to that of the portion of the cap. When one of the base and the cap is rotated relative to the other to cause one of the portion of the base and the portion of the cap to slide along the other, the locking means is moved outwardly.

With this arrangement, tensile forces act on the opposite ends of the axle, making it possible to absorb looseness of the axle with respect to the rotary elements.

Advantageously, one of the base and the cap has a stopper formed thereon, while the other of the base and the cap has a recess formed therein. In this case, rotation of one of the base and the cap relative to the other moves the cap away from the base and is prevented when the stopper is received in the recess, thereby ensuring the coupling between the rotary elements and the axle and preventing the rotary elements from being removed from the axle.

Alternatively, the yo-yo further includes a biasing member mounted in the cavity for biasing the locking means outwardly, thereby exerting a tensile force on the axle. The tensile force acts to eliminate looseness of the axle with respect to the rotary elements.

In another form of the present invention, a locking device having a pair of locking means is mounted in the cavity, and the pair of locking means have respective holding portions for detachably holding the engaging portion therebetween.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

This application is based on an application No. 10-209698 filed Jul. 24, 1998 in Japan, the content of which is incorporated hereinto by reference.

Figure 1:
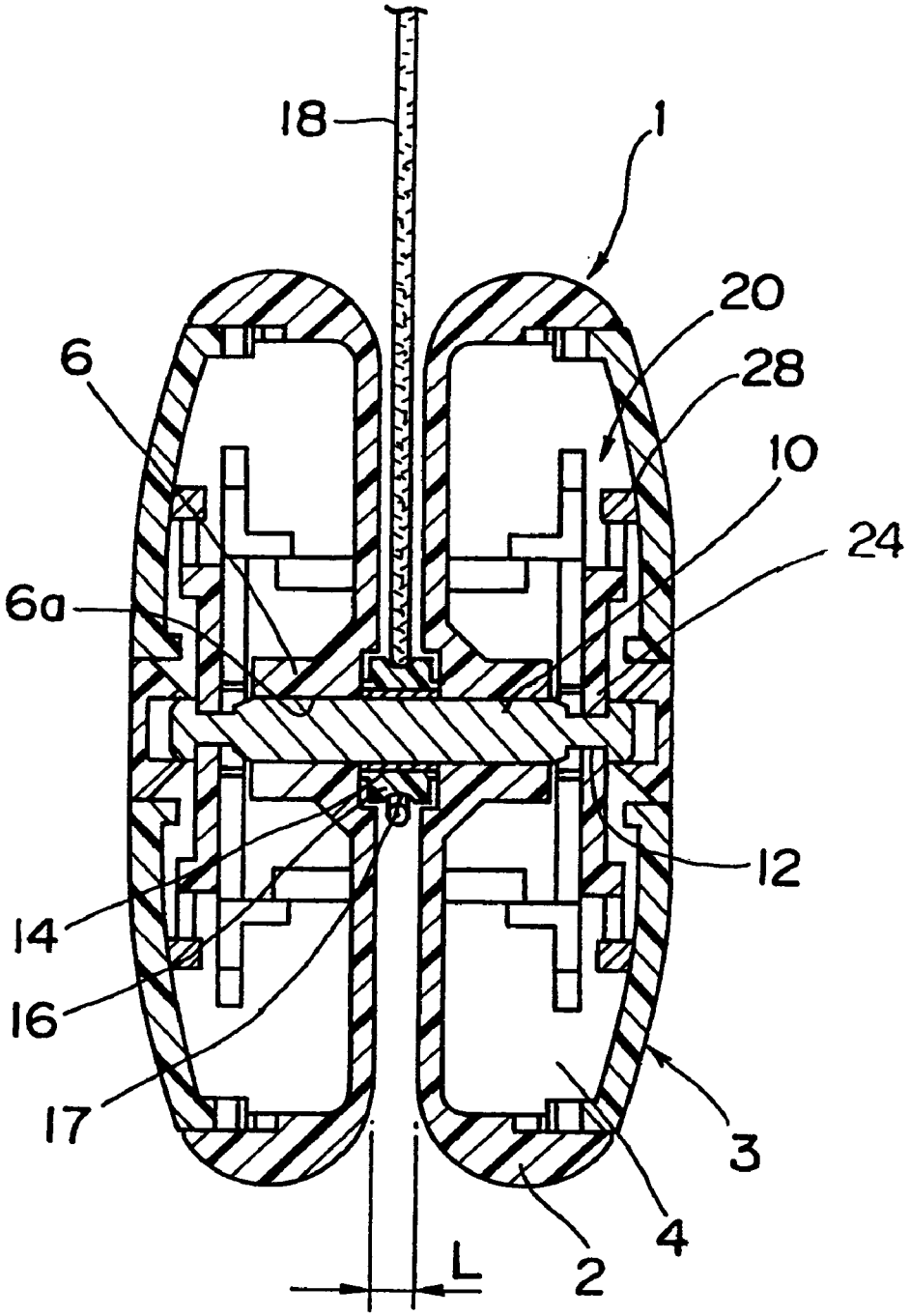
FIG. 1 is a vertical sectional view of a yo-yo according to a first embodiment of the present invention.
Figure 2:
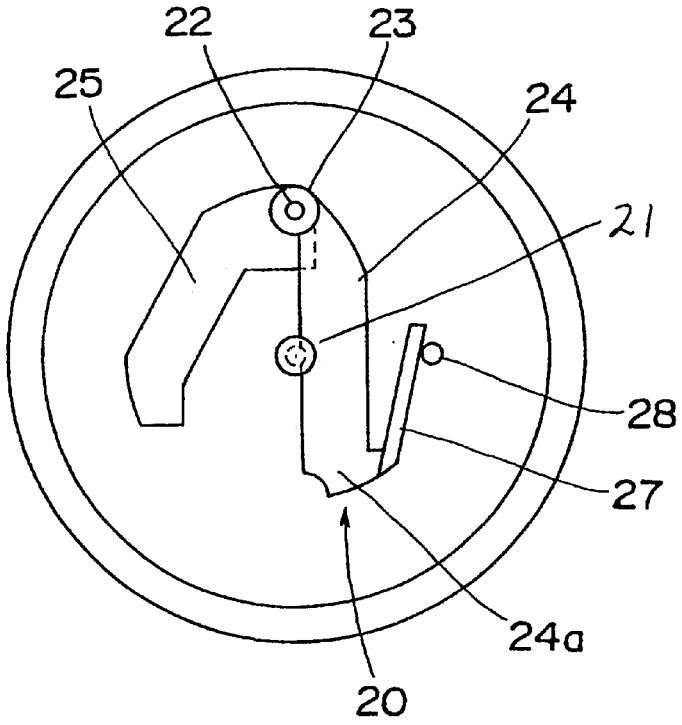
FIG. 2 is a view of an internal face of a cap mounted on each rotary element in the yo-yo of FIG. 1.

Referring now to the drawings, there is shown in FIGS. 1 and 2 a yo-yo according to a first embodiment of the present invention. As shown therein, the yo-yo includes two yo-yo halves or rotary elements 1 spaced a predetermined distance from each other. Each of the rotary elements 1 has a base 2 and a cap 3 disposed outwardly of the base 2, both of which are coupled together. Each of the base 2 and the cap 3 is made of a resin. Each of the rotary elements 1 also has a cavity 4 defined therein between the base 2 and the cap 3. Even if the rotary elements 1 are of a complicated configuration, both the base 2 and the cap 3 can be readily made by, for example, injection-molding. Both of them can also be made by cast molding, compression molding, injection and compression molding, transfer molding, or lathed and polished molding. However, the base 2 and the cap 3 can be made of a metal using the current metal-forming techniques.

The base 2 has a bearing portion 6 integrally formed therewith at the center thereof in which an axle 10 is detachably received. Although the axle 10 is normally formed into a cylindrical shape in view of easy manufacture and initial cost, it may have a partially flat cross-section or a polygonal cross-section. In this case, if the shape of a through-hole 6*a* formed in the bearing portion 6 is made substantially the same as that of the axle 10, the axle 10 can be readily fixed to the rotary elements 1 for rotation together therewith. The axle 10 has circumferentially grooved engaging portions 12 formed at opposite ends thereof, respectively, that are engaged with the cap 3 by means of associated locking devices 20.

Each of the locking devices 20 includes a pair of locking means (or locking parts) (only one is shown in FIG. 2). The pair of locking means are symmetrically arranged with respect to the center of the cap 3 (see FIG. 11). Each locking means includes a support member 22 radially spaced a predetermined distance from the center of the cap 3 that has a generally U-shaped cross section. Each locking means also includes an engaging lever 24 having an arcuated holding portion 21 for engagement with the grooved engaging portion 12 of the axle 10, a balancing lever 25 formed on the opposite side of the engaging lever 24 with respect to the axle 10 and having a weight greater than the engaging lever 24, and a mounting portion 23 to which one end of the engaging lever 24 and one end of the balancing lever 25 are secured for rotational movement about the support member 22. Each locking means further includes an elastic member 27 extending outwardly from the other end 24*a* of the engaging lever 24 and a stopper 28 secured to the cap 3 and held in contact with the elastic member 27. Because the balancing lever 25 is heavier than the engaging lever 24, a centrifugal force created at all times during spinning of the yo-yo so as to act on the balancing lever 25 presses the arcuated holding portion 21 inwardly against the grooved engaging portion 12 of the axle 10 via the support member 22. As a result, the grooved engaging portion 12 of the axle 10 is sandwiched between and securely held by the two holding portions 21 of the engaging levers 24.

The axle 10 is loosely inserted into a cylindrical spacer 14 interposed between the two rotary elements 1. The spacer 14 is made of a metal such as stainless steel or a resin such as polyacetal. The spacer 14 acts to maintain the distance L between the two rotary elements 1. A generally cylindrical spool 16 having an axial length slightly shorter than the spacer 14 is securely fitted to the external surface of the spacer 14. The spool 16 is made of a metal or a resin.

The spool 16 has a circumferential groove 17 defined in the external surface thereof and at the center thereof with respect to the axial direction thereof. The circumferential groove 17 has an arcuated cross-section, and a yo-yo string 18 is fastened about the circumferential groove 17. The circumferential groove 17 plays a very important role such that the yo-yo string 18 may be located around the center of gravity of the yo-yo body during spinning, providing high performance by free spinning.

Figure 3A:
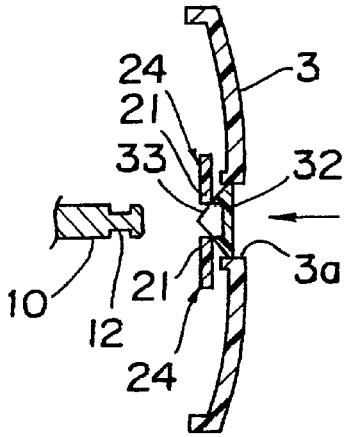
FIG. 3A is a vertical sectional view of the cap of FIG. 2, particularly depicting the condition before an axle is fastened thereto.
Figure 3B:
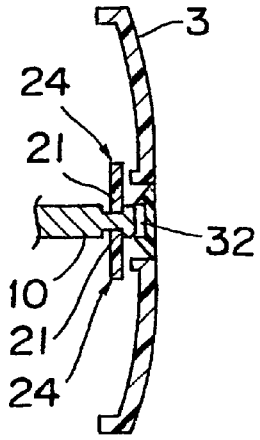
FIG. 3B is a view similar to FIG. 3A, but depicting the condition after the axle has been fastened to the cap.

FIGS. 3A and 3B depict the locking device 20 before and after assembly or disassembly of the yo-yo. As shown therein, the cap 3 has a round hole 3*a* defined therein at the center thereof, and an opener 32 is slidably mounted in the round hole 3*a* from inside. The opener 32 has an inclined portion 33 that is inwardly tapered off. A free end of the inclined portion 33 is inserted into a space between the two engaging levers 24 of the pair of locking means of the locking device 20.

As shown in FIG. 3A, when the opener 32 is pressed inwardly during assembly of the yo-yo, the inclined surface of the inclined portion 33 is brought into contact with the arcuated holding portions 21 of the engaging levers 24 and then causes the engaging levers 24 to slide radially outwardly against the biasing forces of the elastic members 27, thereby opening the arcuated holding portions 21. Under such condition, the grooved engaging portion 12 of the axle 10 can be readily engaged with the arcuated holding portions 21 by inserting the end of the axle 10 into the space between the engaging levers 24, as shown in FIG. 3B.

Under the condition shown in FIG. 3B, when the opener 32 is pressed inwardly, the mutually mated engaging levers 24 are moved away from each other to open the arcuated holding portions 21, making it possible to disengage the grooved engaging portion 12 of the axle 10 therefrom. That is, the opener 32 acts as an engagement releasing member for releasing the engagement of the grooved engaging portion 12 with the arcuated holding portions 21.

Figure 4:
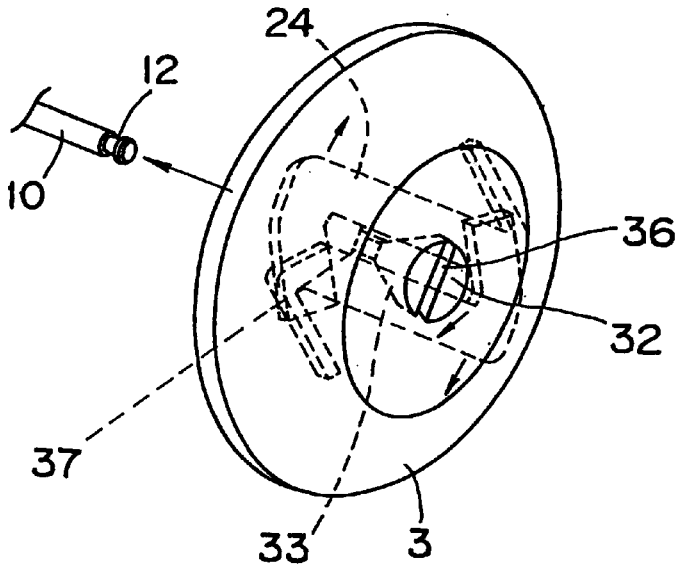
FIG. 4 is a perspective view of the cap of FIG. 2.

Although it is sufficient if the opener 32 has a flat external surface, it may have a radially extending groove 36 defined in the external surface thereof and a guide rib 37 formed on the free end of the inclined portion 33, as shown in FIG. 4. In this case, when the opener 32 that is rotatably mounted in the round hole 3*a* of the cap 3 is rotated by inserting a rotating tool such as, for example, a driver or a coin into the radially extending groove 36, the guide rib 37 formed on the opener 32 is also rotated, which in turn causes the mutually mated engaging levers 24 to slide radially outwardly, thereby opening the arcuated holding portions 21. Accordingly, the engagement of the grooved engaging portion 12 of the axle 10 with the arcuated holding portions 21 is released.

In the manner as described above, locking or unlocking of the axle 10 can be readily conducted using the locking devices 20.

Figure 5:
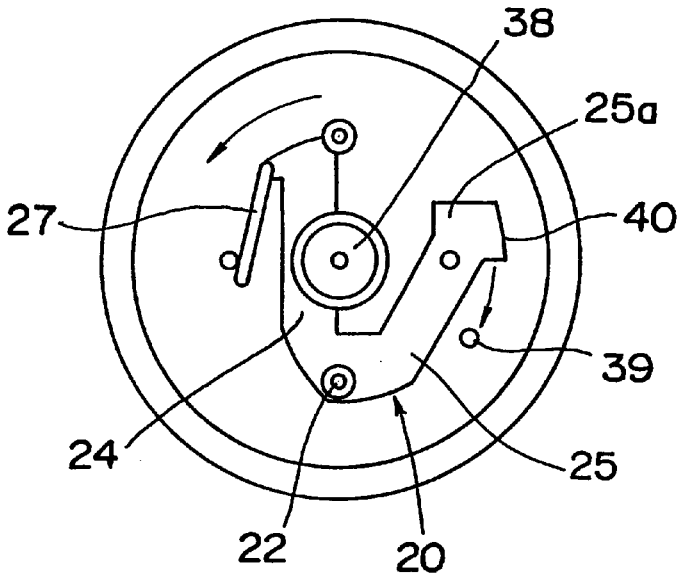
FIG. 5 is a view similar to FIG. 2, but particularly depicting a modified form of a locking device mounted on the cap.

FIG. 5 depicts a modification of the locking device 20. Although the locking device 20 includes a pair of locking means, only one locking means is depicted.

As shown in FIG. 5, a pin 39 is securely mounted on or integrally formed with the base 2, while an outwardly protruding portion 40 is integrally formed with a free end 25*a* of the balancing lever 25.

In disassembling the yo-yo, when one of the base 2 and the cap 3 is rotated relative to the other, the outwardly protruding portion 40 of the balancing lever 25 is brought into contact with the pin 39. At this moment, the engaging lever 24 is caused to slide radially outwardly against the biasing force of the elastic member 27, thereby releasing the locking of the axle 10 by the locking device 20.

Although in FIG. 5 reference numeral 38 denotes a closure member for closing the center hole 3*a* of the cap 3, the center hole 3*a* and the closure member 38 may be dispensed with.

Assembling and disassembling of the yo-yo according to the present invention are discussed hereinafter with reference to FIGS. 6 to 8.

Figure 6:
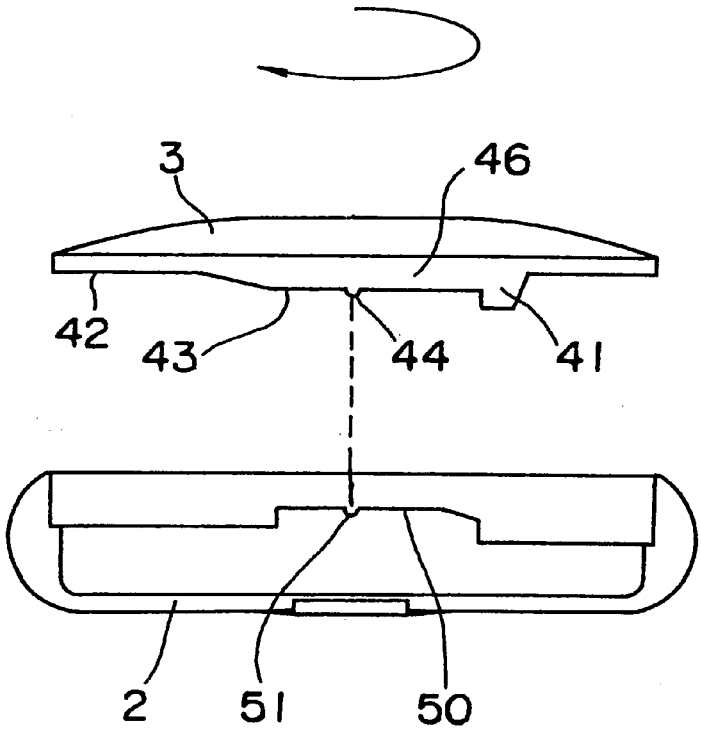
FIG. 6 is a side view of the cap and a base to which the cap is secured.
Figure 7:
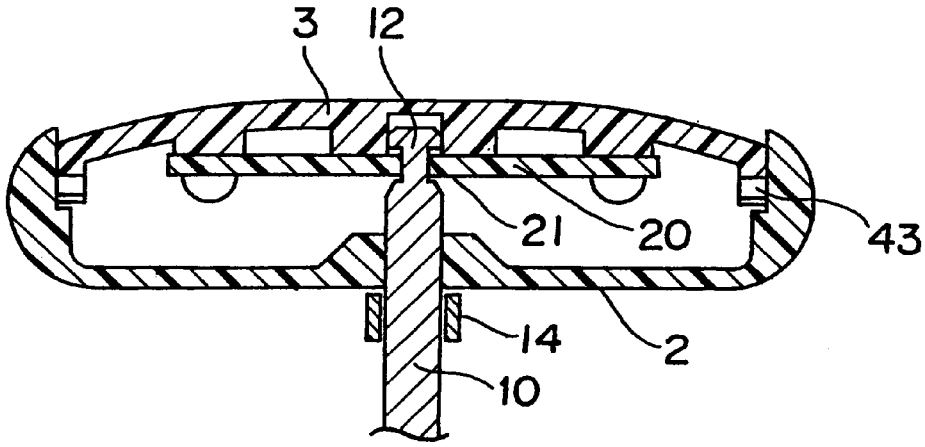
FIG. 7 is a sectional view of each rotary element in the course of assembly.
Figure 8:
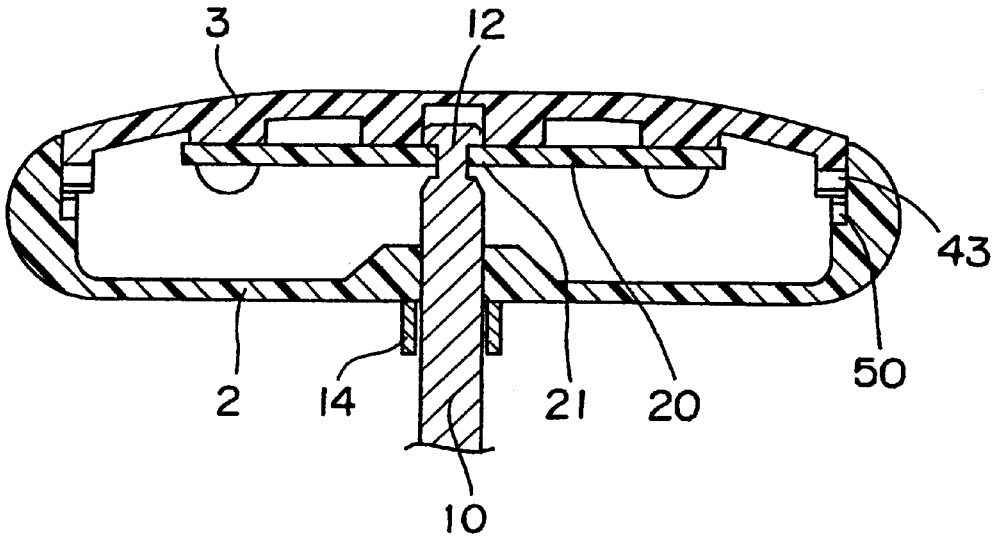
FIG. 8 is a view similar to FIG. 7, but particularly depicting the condition after the assembly.

As shown in FIGS. 6 to 8, the cap 3 has a flange 46 formed at an outer periphery thereof. The flange 46 includes a first side wall 41, a second side wall 42, an inclined portion 43 connecting the first side wall 41 and the second side wall 42, and a stopper 44 formed on the first side wall 41. The first side wall 41 is 0.5 to 1.0 mm higher than the second side wall 42, and the inclined portion 43 is formed generally straight or arcuated.

On the other hand, the base 2 having a generally U-shaped cross-section includes a guide portion 50 formed on the inner surface of a side wall thereof. The guide portion 50 has a configuration substantially complementary to that of the flange 46 of the cap 3 and also has a recess 51 of a configuration substantially complementary to that of the stopper 44.

In assembling the yo-yo, when the engaging portion 12 of the axle 10 is inserted between the arcuated holding portions 21 of the locking device 20 under the condition in which the second side wall 42 of the flange 46 of the cap 3 is opposed to the guide portion 50 of the base 2, the cap 3 sets slightly within the base 2, as shown in FIG. 7, thus causing axial looseness of the axle 10.

When the cap 3 is rotated relative to the base 2 in the direction shown by an arrow in FIG. 6, the inclined portion 43 of the cap 3 is caused to slide along the guide portion 50 of the base 2. At this moment, the cap 3 together with the locking device 20 is moved gradually outwardly away from the base 2, and the engaging portion 12 of the axle 10 is drawn outwardly by the arcuated holding portions 21 of the locking device 20, as shown in FIG. 8. When the cap 3 is further rotated relative to the base 2 to introduce the stopper 44 of the cap 3 into the recess 51 of the base 2, the spacing between the two rotary elements 1 is slightly narrowed and the base 2 is pressed against the end surface of the spacer 14, thereby eliminating the axial looseness of the axle 10 and positively fastening the rotary elements 1 on the axle 10.

It is to be noted that although in the structure shown in FIG. 6 the first side wall 41, the second side wall 42, the inclined portion 43 and the like are formed with the flange 46 at the outer periphery of the cap 3, they may be formed at any suitable portion other than the outer periphery of the cap 3, with the guide portion being formed at a portion on the base 2 corresponding thereto.

It is also to be noted that although in the structure shown in FIG. 6 the stopper 44 and the recess 51 are formed on the cap 3 and in the base 2, respectively, they may be formed on the base 2 and in the cap 3, respectively.

Figure 9:
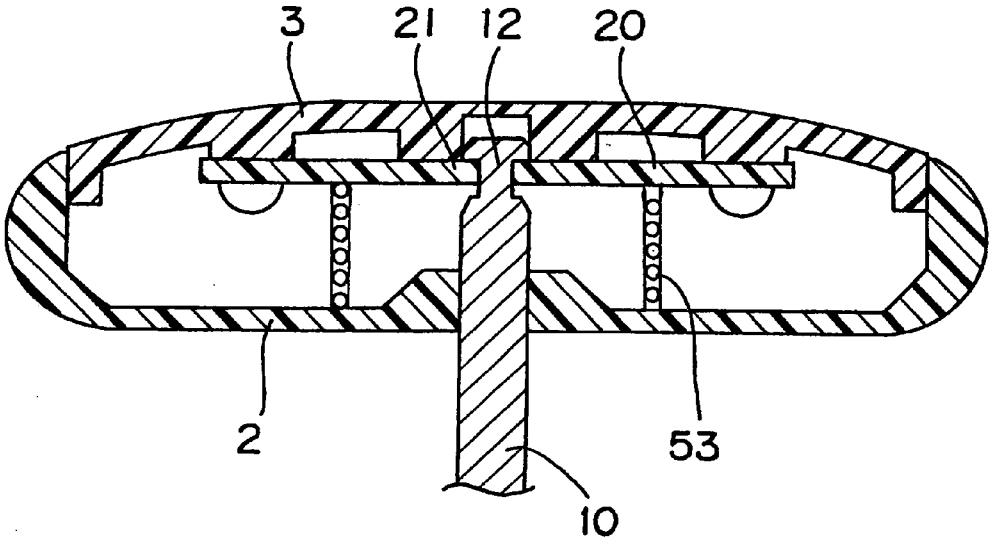
FIG. 9 is a view similar to FIG. 8, but according to a modification thereof.

FIG. 9 depicts a modification of the structure shown in FIG. 6, in which the first side wall 41, the second side wall 42 and the inclined portion 43 are not provided. The structure shown in FIG. 9 is provided with a compression coil spring 53 interposed between the base 2 and the locking device 20 mounted on the cap 3. The compression coil spring 53 acts to press the locking device 20 outwardly, which in turn exerts a tensile force on the axle 10, thereby eliminating looseness of the axle 10.

A tension coil spring may be used in place of the compression coil spring 53. In this case, the tension coil spring is interposed between the cap 3 and the locking device 20, and the looseness of the axle 10 is eliminated by making use of a tensioning force of the tension coil spring.

It is to be noted here that although in the above-described embodiment the locking device 20 mounted in each of the pair of rotary elements 1 is comprised of a pair of locking means, the locking device may be comprised of three or four locking means at intervals of 120° or 90°. Although the use of a plurality of locking means is preferred for each locking device 20 in terms of reliability, it is possible to use only one locking means, as shown in, for example, FIG. 2.

Figure 10:
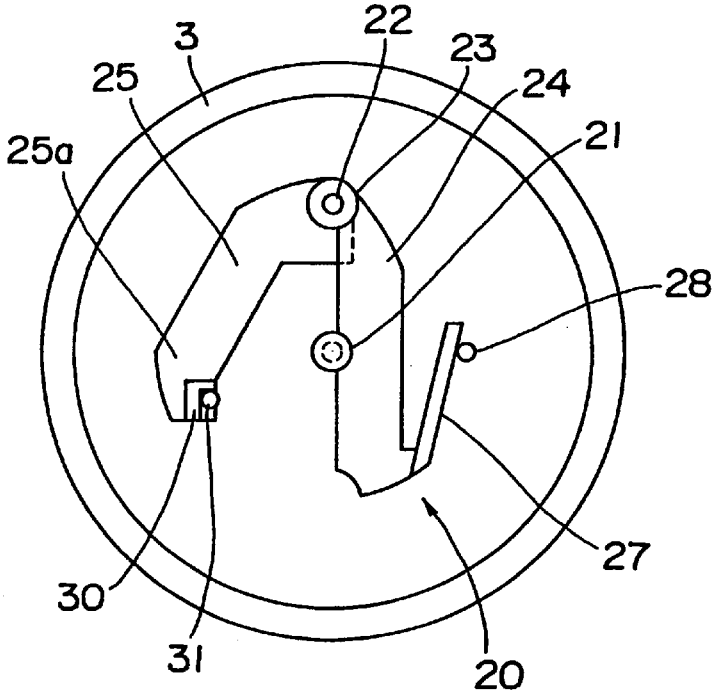
FIG. 10 is a view similar to FIG. 2, but according to a second embodiment of the present invention.
Figure 11:
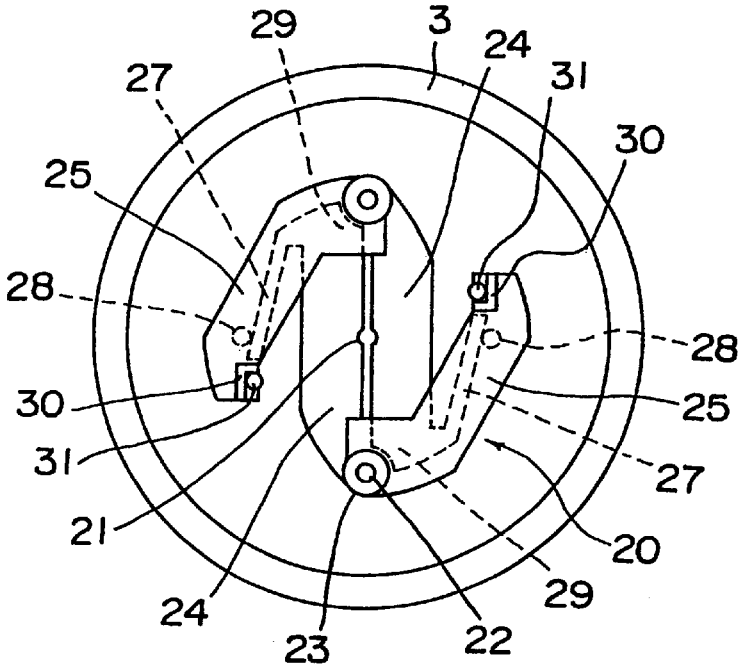
FIG. 11 is a view of an internal face of the cap of FIG. 10, particularly depicting the condition after a pair of locking means have been mounted therein.

FIGS. 10 and 11 depict a yo-yo according to a second embodiment of the present invention. FIG. 10 depicts only the cap 3 as viewed from inside, with the base 2 removed. The locking device 20 is mounted on the cap 3.

The locking device 20 includes a plurality of (for example, two) locking means (or locking parts) (only one is shown in FIG. 10). In this locking device 20, one end 29 of the engaging lever 24 of one locking means is disposed in close proximity to the support member 22 of the other locking means and, hence, the movement of the former is restricted by the latter, thus enhancing the reliability in the fastening of the axle 10.

Furthermore, the free end 25*a* of the balancing lever 25 has a locking portion 30 integrally formed therewith, while the base 2 has a locking member 31 securely mounted thereon or integrally formed therewith. When the base 2 and the cap 3 are coupled together by rotating one of them relative to the other, the locking member 31 of the base 2 is brought into contact with the locking portion 30 of the balancing lever 25, thereby completely preventing movement of the locking device 20 after assemblage. Because the arcuated holding portions 21 of the locking device 20 and the engaging portion 12 of the axle 10 act as one rigid body, removal of the rotary elements 1 from the axle 10 does not occur during operation.

It is to be noted here that the locking means having the locking portion may be mounted on the base 2, while the locking member may be formed on the cap 3.

Figure 12:
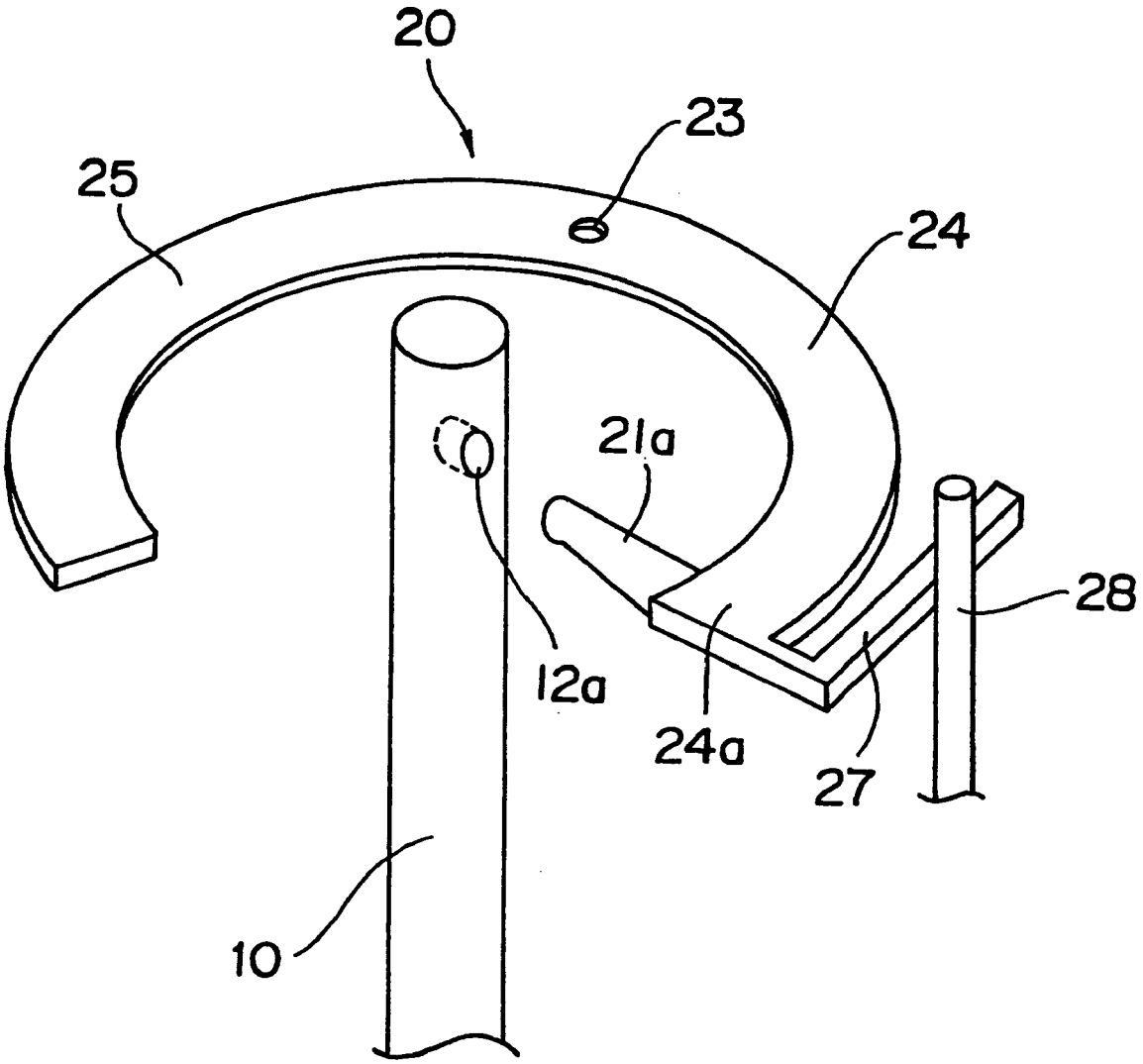
FIG. 12 is a perspective view of a locking means mounted in a yo-yo according to a third embodiment of the present invention.

FIG. 12 depicts a locking device 20 mounted in a yo-yo according to a third embodiment of the present invention.

Although in the first or second embodiment the axle 10 is held on the cap 3 by the engagement of the grooved engaging portion 12 formed in the axle 10 with the arcuated holding portions 21 of the locking device 20, the structure shown in FIG. 12 can be employed in place of the structure according to the first or second embodiment.

More specifically, a radially inwardly extending projection 21*a* is securely mounted on or integrally formed with an end 24*a* of an engaging lever 24 from which an elastic member 27 extends, while a radially extending hole 12*a* is formed in an associated end of the axle 10. In assembling the yo-yo, the end 24*a* of the engaging lever 24 is pressed outwardly against a biasing force of the elastic member 27, and the radially inwardly extending projection 21*a* is positioned with respect to the radially extending hole 12*a*. Thereafter, the axle 10 is held on the cap 3 by inserting the radially inwardly extending projection 21*a* into the radially extending hole 12*a*.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A yo-yo comprising:

first and second rotary elements spaced from each other, said first rotary element having a cavity defined therein;

a bearing portion formed on each of said first and second rotary elements at a center thereof;

an axle defining a rotation axis and being detachably received in said bearing portion so as to be rotatable together with said rotary elements about said rotation axis, said axle having an engaging portion formed at one of opposite ends thereof;

a generally cylindrical spool interposed between said rotary elements, said axle being loosely inserted into said generally cylindrical spool; and at least one locking part mounted in said cavity and having a holding portion for pressing radially inwardly against said engaging portion at all times during rotation of said rotary elements about said rotation axis, thereby holding said first rotary element on said one of the opposite ends of said axle;

wherein said at least one locking part has an elastic member for biasing said holding portion against said engaging portion; and wherein said at least one locking part comprises a support member, a first and a second lever extending from said support member so as to be positioned on respective sides of said axle, said holding portion being formed with said first lever and pressed against said engaging portion by making use of a centrifugal force created on said second lever during rotation of said rotary elements.

2. The yo-yo according to claim 1, wherein said elastic member extends from a free end of said first lever.

3. A yo-yo comprising:

first and second rotary elements spaced from each other, said first rotary element having a cavity defined therein;

a bearing portion formed on each of said first and second rotary elements at a center thereof;

an axle defining a rotation axis and being detachably received in said bearing portion so as to be rotatable together with said rotary elements about said rotation axis, said axle having an engaging portion formed at one of opposite ends thereof;

a generally cylindrical spool interposed between said rotary elements, said axle being loosely inserted into said generally cylindrical spool; and at least one locking part mounted in said cavity and having a holding portion for pressing radially inwardly against said engaging portion at all times during rotation of said rotary elements about said rotation axis, thereby holding said first rotary element on said one of the opposite ends of said axle;

wherein said engaging portion is a radially extending hole formed in said axle, and said holding portion comprises a radially inwardly extending projection formed on said at least one locking part.

4. A yo-yo comprising:

first and second rotary elements spaced from each other, said first rotary element having a cavity defined therein;

a bearing portion formed on each of said first and second rotary elements at a center thereof;

an axle defining a rotation axis and being detachably received in said bearing portion so as to be rotatable together with said rotary elements about said rotation axis, said axle having an engaging portion formed at one of opposite ends thereof;

a generally cylindrical spool interposed between said rotary elements, said axle being loosely inserted into said generally cylindrical spool; and at least one locking part mounted in said cavity and having a holding portion for pressing radially inwardly against said engaging portion at all times during rotation of said rotary elements about said rotation axis, thereby holding said first rotary element on said one of the opposite ends of said axle;

wherein said at least one locking part has a locking portion, and said first rotary element has a locking member, said locking member being brought into contact with said locking portion to prevent engagement of said holding portion with said engaging portion from being released.

5. The yo-yo according to claim 4, wherein said first rotary element comprises a base and a cap disposed outwardly of said base, said at least one locking parts having said locking portion being mounted on one of said base and said cap, said locking member being mounted on the other of said base and said cap, said locking member being brought into contact with said locking portion by rotating one of said base and said cap relative to the other.

6. A yo-yo comprising:

first and second rotary elements spaced from each other, said first rotary element having a cavity defined therein;

a bearing portion formed on each of said first and second rotary elements at a center thereof;

an axle defining a rotation axis and being detachably received in said bearing portion so as to be rotatable together with said rotary elements about said rotation axis, said axle having an engaging portion formed at one of opposite ends thereof;

a generally cylindrical spool interposed between said rotary elements, said axle being loosely inserted into said generally cylindrical spool; and at least one locking part mounted in said cavity and having a holding portion for pressing radially inwardly against said engaging portion at all times during rotation of said rotary elements about said rotation axis, thereby holding said first rotary element on said one of the opposite ends of said axle;

wherein said first rotary element comprises a base and a cap disposed outwardly of said base, said cap having an engagement releasing member mounted thereon for releasing engagement of said engaging portion with said holding portion; and wherein said engagement releasing member comprises an inclined portion having an inclined surface, and wherein when said engagement releasing member is pressed inwardly, the inclined surface of said inclined portion is brought into contact with said holding portion and then causes said holding portion to slide radially outwardly, thereby releasing the engagement of said engaging portion with said holding portion.

7. The yo-yo according to claim 6, wherein said engagement releasing member has a guide portion formed thereon and is rotatably mounted on said cap, and wherein when said engagement releasing member is rotated, said guide portion causes said holding portion to slide radially outwardly, thereby releasing the engagement of said engaging portion with said holding portion.

8. A yo-yo comprising:

first and second rotary elements spaced from each other, said first rotary element having a cavity defined therein;

a bearing portion formed on each of said first and second rotary elements at a center thereof;

an axle defining a rotation axis and being detachably received in said bearing portion so as to be rotatable together with said rotary elements about said rotation axis, said axle having an engaging portion formed at one of opposite ends thereof;

a generally cylindrical spool interposed between said rotary elements, said axle being loosely inserted into said generally cylindrical spool; and at least one locking part mounted in said cavity and having a holding portion for pressing radially inwardly against said engaging portion at all times during rotation of said rotary elements about said rotation axis, thereby holding said first rotary element on said one of the opposite ends of said axle;

wherein said first rotary element comprises a base and a cap disposed outwardly of said base, a portion of said cap having a first side wall, a second side wall lower than said first side wall, and an inclined portion connecting said first and second side walls, a portion of said base being of a configuration substantially complementary to that of said portion of said cap, and wherein when one of said base and said cap is rotated relative to the other to cause one of said portion of said base and said portion of said cap to slide along the other, said at least one locking part is moved outwardly.

9. The yo-yo according to claim 8, wherein one of said base and said cap has a stopper formed thereon, while the other of said base and said cap has a recess formed therein, and wherein rotation of one of said base and said cap relative to the other moves said cap away from said base and is prevented when said stopper is received in said recess.

10. A yo-yo comprising:

first and second rotary elements spaced from each other, said first rotary element having a cavity defined therein;

a bearing portion formed on each of said first and second rotary elements at a center thereof;

an axle defining a rotation axis and being detachably received in said bearing portion so as to be rotatable together with said rotary elements about said rotation axis, said axle having an engaging portion formed at one of opposite ends thereof;

a generally cylindrical spool interposed between said rotary elements, said axle being loosely inserted into said generally cylindrical spool;

at least one locking part mounted in said cavity and having a holding portion for pressing radially inwardly against said engaging portion at all times during rotation of said rotary elements about said rotation axis, thereby holding said first rotary element on said one of the opposite ends of said axle; and a biasing member mounted in said cavity for biasing said at least one locking part outwardly, thereby exerting a tensile force on said axle.

11. A yo-yo comprising:

first and second rotary elements spaced from each other, said first rotary element having a cavity defined therein;

a bearing portion formed on each of said first and second rotary elements at a center thereof;

an axle defining a rotation axis and being detachably received in said bearing portion so as to be rotatable together with said rotary elements about said rotation axis, said axle having an engaging portion formed at one of opposite ends thereof;

a generally cylindrical spool interposed between said rotary elements, said axle being loosely inserted into said generally cylindrical spool; and a locking device mounted in said cavity and having a pair of locking parts, said pair of locking parts having respective holding portions for detachably holding said engaging portion therebetween, said holding portions pressing radially inwardly against said engaging portion at all times during rotation of said rotary elements about said rotation axis;

wherein said pair of locking parts have respective elastic members for biasing said holding portions against said engaging portion; and wherein each of said pair of locking parts comprises a support member, a first and a second lever extending from said support member so as to be positioned on respective sides of said axle, each of said holding portions being formed with said first lever and pressed against said engaging portion by making use of a centrifugal force created on said second lever during rotation of said rotary elements.

12. The yo-yo according to claim 11, wherein said elastic members extend from a free ends of said first levers respectively.

13. A yo-yo comprising:

first and second rotary elements spaced from each other, said first rotary element having a cavity defined therein;

a bearing portion formed on each of said first and second rotary elements at a center thereof;

an axle defining a rotation axis and being detachably received in said bearing portion so as to be rotatable together with said rotary elements about said rotation axis, said axle having an engaging portion formed at one of opposite ends thereof;

a generally cylindrical spool interposed between said rotary elements, said axle being loosely inserted into said generally cylindrical spool; and a locking device mounted in said cavity and having a pair of locking parts, said pair of locking parts having respective holding portions for detachably holding said engaging portion therebetween, said holding portions pressing radially inwardly against said engaging portion at all times during rotation of said rotary elements about said rotation axis;

wherein said engaging portion is a radially extending hole formed in said axle, and each of said holding portions comprises a radially inwardly extending projection formed on each of said pair of locking parts.

14. A yo-yo comprising:

first and second rotary elements spaced from each other, said first rotary element having a cavity defined therein;

a bearing portion formed on each of said first and second rotary elements at a center thereof;

an axle defining a rotation axis and being detachably received in said bearing portion so as to be rotatable together with said rotary elements about said rotation axis, said axle having an engaging portion formed at one of opposite ends thereof;

a generally cylindrical spool interposed between said rotary elements, said axle being loosely inserted into said generally cylindrical spool; and a locking device mounted in said cavity and having a pair of locking parts, said pair of locking parts having respective holding portions for detachably holding said engaging portion therebetween, said holding portions pressing radially inwardly against said engaging portion at all times during rotation of said rotary elements about said rotation axis;

wherein said pair of locking parts have respective locking portions, and said first rotary element has two locking members, said locking members being brought into contact with said locking portions to prevent engagement of said holding portions with said engaging portion from being released.

15. The yo-yo according to claim 14, wherein said first rotary element comprises a base and a cap disposed outwardly of said base, said pair of locking parts having said locking portions being mounted on one of said base and said cap, said locking members being mounted on the other of said base and said cap, said locking members being brought into contact with said locking portions by rotating one of said base and said cap relative to the other.

16. A yo-yo comprising:

first and second rotary elements spaced from each other, said first rotary element having a cavity defined therein;

a bearing portion formed on each of said first and second rotary elements at a center thereof;

an axle defining a rotation axis and being detachably received in said bearing portion so as to be rotatable together with said rotary elements about said rotation axis, said axle having an engaging portion formed at one of opposite ends thereof;

a generally cylindrical spool interposed between said rotary elements, said axle being loosely inserted into said generally cylindrical spool; and a locking device mounted in said cavity and having a pair of locking parts, said pair of locking parts having respective holding portions for detachably holding said engaging portion therebetween, said holding portions pressing radially inwardly against said engaging portion at all times during rotation of said rotary elements about said rotation axis;

wherein said first rotary element comprises a base and a cap disposed outwardly of said base, said cap having an engagement releasing member mounted thereon for releasing engagement of said engaging portion with said holding portions; and wherein said engagement releasing member comprises an inclined portion having an inclined surface, and wherein when said engagement releasing member is pressed inwardly, the inclined surface of said inclined portion is brought into contact with said holding portions and then causes said holding portion to slide radially outwardly, thereby releasing the engagement of said engaging portion with said holding portions.

17. The yo-yo according to claim 16, wherein said engagement releasing member has a guide portion formed thereon and is rotatably mounted on said cap, and wherein when said engagement releasing member is rotated, said guide portion causes said holding portions to slide radially outwardly, thereby releasing the engagement of said engaging portion with said holding portions.

18. A yo-yo comprising:

first and second rotary elements spaced from each other, said first rotary element having a cavity defined therein;

a bearing portion formed on each of said first and second rotary elements at a center thereof;

an axle defining a rotation axis and being detachably received in said bearing portion so as to be rotatable together with said rotary elements about said rotation axis, said axle having an engaging portion formed at one of opposite ends thereof;

a generally cylindrical spool interposed between said rotary elements, said axle being loosely inserted into said generally cylindrical spool; and a locking device mounted in said cavity and having a pair of locking parts, said pair of locking parts having respective holding portions for detachably holding said engaging portion therebetween, said holding portions pressing radially inwardly against said engaging portion at all times during rotation of said rotary elements about said rotation axis;

wherein said first rotary element comprises a base and a cap disposed outwardly of said base, a portion of said cap having a first side wall, a second side wall lower than said first side wall, and an inclined portion connecting said first and second side walls, a portion of said base being of a configuration substantially complementary to that of said portion of said cap, and wherein when one of said base and said cap is rotated relative to the other to cause one of said portion of said base and said portion of said cap to slide along the other, said pair of locking parts are moved outwardly.

19. The yo-yo according to claim 18, wherein one of said base and said cap has a stopper formed thereon, while the other of said base and said cap has a recess formed therein, and wherein rotation of one of said base and said cap relative to the other moves said cap away from said base and is prevented when said stopper is received in said recess.

20. A yo-yo comprising:

first and second rotary elements spaced from each other, said first rotary element having a cavity defined therein;

a bearing portion formed on each of said first and second rotary elements at a center thereof;

an axle defining a rotation axis and being detachably received in said bearing portion so as to be rotatable together with said rotary elements about said rotation axis, said axle having an engaging portion formed at one of opposite ends thereof;

a generally cylindrical spool interposed between said rotary elements, said axle being loosely inserted into said generally cylindrical spool;

a locking device mounted in said cavity and having a pair of locking parts, said pair of locking parts having respective holding portions for detachably holding said engaging portion therebetween, said holding portions pressing radially inwardly against said engaging portion at all times during rotation of said rotary elements about said rotation axis; and a biasing member mounted in said cavity for biasing said pair of locking parts outwardly, thereby exerting a tensile force on said axle.

* * * * *